US006159651A

United States Patent [19]

Ishihara

[11] Patent Number: 6,159,651

[45] Date of Patent: Dec. 12, 2000

[54] LASER ABLATIVE RECORDING MATERIAL

[75] Inventor: Makoto Ishihara, Kanagawa, Japan

[73] Assignee: Fuji Photo Film Co., Ltd., Kanagawa, Japan

[21] Appl. No.: 09/059,416

[22] Filed: Apr. 14, 1998

[30] Foreign Application Priority Data

Apr. 15, 1997 [JP] Japan ..... 9-097807
Jun. 4, 1997 [JP] Japan ..... 9-146860

[51] Int. Cl.[7] ..... B41M 5/26

[52] U.S. Cl. ..... 430/200; 430/201; 430/945; 430/270.15; 503/227

[58] Field of Search ..... 430/200, 201, 430/270.15, 945; 503/227

[56] References Cited

U.S. PATENT DOCUMENTS

| | | | |
|---|---|---|---|
| 5,326,689 | 7/1994 | Maruyama | 430/530 |
| 5,372,985 | 12/1994 | Chang et al. | 503/227 |
| 5,468,591 | 11/1995 | Pearce et al. | 430/201 |
| 5,529,884 | 6/1996 | Tutt et al. | 430/201 |
| 5,534,383 | 7/1996 | Takahashi et al. | 430/201 |
| 5,576,144 | 11/1996 | Pearce et al. | 430/200 |
| 5,578,824 | 11/1996 | Koguchi et al. | 250/318 |
| 5,582,669 | 12/1996 | Gove et al. | 156/239 |
| 5,698,366 | 12/1997 | Tutt et al. | 430/200 |
| 5,718,995 | 2/1998 | Eihorst et al. | 430/200 |

FOREIGN PATENT DOCUMENTS

| | | |
|---|---|---|
| 0698503 | 2/1996 | European Pat. Off. . |
| 2-301033 | 12/1990 | Japan . |
| 3-073438 | 3/1991 | Japan . |
| 6118561 | 4/1994 | Japan . |
| 7-041501 | 2/1995 | Japan . |
| 7253634 | 10/1995 | Japan . |

OTHER PUBLICATIONS

BArreto, Ernesto "Corona Discharge" in "Encyclopedia of Physics" pp. 191–193, 1991.

*Primary Examiner*—Martin Angebranndt
*Attorney, Agent, or Firm*—Sughrue, Mion, Zinn, Macpeak & Seas, PLLC

[57] ABSTRACT

A laser ablative recording material having at least one image forming layer on a support surface-treated by at least one of ultraviolet irradiation treatment, glow discharge treatment and flame treatment, and having at least one intermediate layer between the image forming layer and the support is disclosed. The laser ablative recording material of the present invention is characterized by high adhesion between the support and the image forming layer and low Dmin.

18 Claims, No Drawings

LASER ABLATIVE RECORDING MATERIAL

Field of the Invention

The present invention relates to a laser ablative recording material, and more particularly to a laser ablative recording material having high adhesion between a surface-treated support and an image forming layer, and having a low Dmin.

Related Art

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. No. 5,330,876, U.S. Pat. No. 5,401,618 and U.S. Pat. No. 5,459,017) disclose recording materials applicable in this method, and Japanese Unexamined Patent Publications Nos. 8-48,053 and 8-72,400 (corresponding to U.S. Pat. No. 5,521,629and U.S. Pat. No. 5,574,493) disclose imaging apparatuses used in this method. Image recording based on the ablation method is accomplished by irradiating a laser from a image forming layer side onto a recording material having a image forming layer comprising a coloring agent, a material having absorption in the laser wavelength region (infrared-absorbing material) and a binder formed on a support. On the spot to which the laser beam has been irradiated, a sharp local change takes place in the image forming layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the coloring agent.

The usefulness of the dye ablation imaging method greatly depends on the efficiency of removing the imaging dye upon laser exposure. As a scale representing this efficiency, the minimum density value (Dmin) of the laser exposed area is employed. A lower Dmin points to a higher dye removing efficiency. Too strong an adhesion between the support and the image forming layer is not preferred, because it makes the Dmin high. Too weak an adhesion, on the other hand, makes the Dmin low, but it is not practical, because the operating efficiency of mounting by a tape, a common practice in the printing industry, becomes poor. Thus, a moderate degree of adhesion between the support and the image forming layer has been considered necessary.

Techniques have been provided for firmly adhering a support to a silver halide emulsion layer, which comprises a protective colloid consisting essentially of gelatin, by treating the surface of the support by various methods. The methods of treatment are described, for example, in the U. S. Pat. Nos. 2,698,241, 2,764,520, 2,864,755, 3,462,335, 3,475,193, 3,143,421, 3,501,301, 3,460,944 and 3,674,531, British Patent Nos. 788,365, 804,005 and 891,469, and Japanese Patent Publication Nos. 48-43122 and 51-446. However, these methods are intended only to produce a strong adhesion between the support and the silver halide emulsion layer. They cannot be applied to a laser ablative recording material which faces the inherent dilemma that too strong an adhesion results in a high Dmin.

Japanese Unexamined Patent Publication Nos. 8-52948 and 8-282099 describe a dye ablative recording material and a laser ablative transfer recording material. The Examples in the specifications of these publications disclose coating a cyanoacrylate barrier intermediate layer or a carbon black-containing image forming layer on a corona discharge-treated polyethylene terephthalate support. However, the publications do not disclose adhesion between these layers and the support, nor the effect of the adhesion on the Dmin. Nor do they give any disclosure of glow discharge treatment, ultraviolet irradiation treatment or flame treatment as a surface treating method.

The present invention aims to provide a method capable of decreasing the Dmin during ablation while increasing adhesion between a support and an image forming layer of a laser ablative recording material. That is, an object of the present invention is to provide a laser ablative recording material having a high adhesion between a support and an image forming layer, and a low Dmin. Another object of the present invention is to provide an image-formed laser ablative record which ensures a high storage stability of an image formed through imagewise heating and easy handling with little image discoloration caused by, for example, fingerprints. Other objects of the present invention would be easily understood from the entire description of this specification by persons skilled in the art.

Summary of the Invention

We, the inventors, have conducted extensive studies in an attempt to attain the foregoing objects. As a result, we have found that the use of a support surface-treated by a specific method can provide a laser ablative recording material having high adhesion and a low Dmin. This finding has led us to accomplish the present invention.

That is, the present invention provides a laser ablative recording material having at least one image forming layer on a support surface-treated by at least one of ultraviolet irradiation treatment, glow discharge treatment and flame treatment, and having at least one intermediate layer between the image forming layer and the support.

According to a preferred embodiment of the present invention, a support surface-treated by glow discharge treatment is used. An $H_2O$ partial pressure in an atmosphere of glow discharge treatment is preferably 5% or higher, and more preferably 10% or higher. Preferably, the pressure of glow discharge treatment is 0.005 to 20 Torr, and the voltage is 500 to 5,000 V. When glow discharge treatment is performed, it is desirable to heat, beforehand, the support to a temperature of 50° C. or higher but the Tg or lower preferably.

According to another preferred embodiment of the present invention, a transparent support is used. Furthermore, a nitric ester of a carboxyalkyl cellulose is used for at least one of the layers on the image forming layer side of the support. Preferably, the nitric ester of the carboxyalkyl cellulose has a degree of nitric ester group substitution per glucose anhydride unit of 0.2 to 2.2, and has a degree of carboxyalkyl ether group substitution per glucose anhydride unit of 0.05 to 1.5.

According to still another preferred embodiment of the present invention, inorganic fine particles are used as an image forming substance in the image forming layer. The inorganic fine particles used are preferably carbon black and/or titanium black.

According to a further preferred embodiment of the present invention, an overcoat layer is provided on the image forming layer. Preferably, polytetrafluoroethylene beads are used for the overcoat layer.

According to a still further preferred embodiment of the present invention, a back layer is provided on the surface of the support on the side opposite to the image forming layer. Preferably, the Beck smoothness of the outermost layer surface of the back layer is 4,000 seconds or less.

According to an additional preferred embodiment of the present invention, the laser ablative recording material has a minimum recording density (Dmin) after laser irradiation of 0.11 or less.

The present invention also provides a laser ablative image-formed record prepared by irradiating a laser onto the above-mentioned laser ablative recording material. According to a preferred embodiment of this invention, a withstanding layer is provided on a surface on the image forming layer side after laser irradiation.

Detailed Description of the Invention

Preferred Embodiments

Now, the laser ablative recording material and the laser ablative image-formed record of the present invention will be described in detail.

As the support in the recording material of the invention, any material may be used so far as it has a size stability and can withstand heat produced by laser irradiation. Materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and poly(tetrafluoro-ethylene-co-hexafluoropropylene; polyethers such as polyoxymethylene; polyacetal; polyolefins such as plystyrene, polyethylene, polypropylene and methylpentenpolymer; and polyimides such as polyimide and polyetherimide. The thickness of the support, not particularly limited, should usually be within a range of from about 5 to about 200 $\mu$m. Transparent supports are preferably used in the invention.

For the recording material of the present invention, an ultraviolet irradiation treated, glow discharge treated or flame treated support is used.

Ultraviolet irradiation treatment is preferably performed by the treating method described in Japanese Patent Publication No. 43-2603, 43-2604 or 45-3828. When a mercury lamp is used, it is preferred to use a high pressure mercury lamp comprising a silica glass tube and having an ultraviolet wavelength of 180 to 320 nm. Ultraviolet irradiation may be carried out during the step of stretching the support, at the time of heat fixing, or after heat fixing. If no problem occurs in the performance of the support whose surface temperature has been raised to about 150° C., a high pressure mercury lamp with a dominant wavelength of 365 nm can be used as a light source. When low temperature treatment is required, a low pressure mercury lamp with a dominant wavelength of 254 nm is used preferably. An ozoneless type high pressure mercury lamp or low pressure mercury lamp may also be used.

The larger the amount of treating light, the higher the strength of adhesion between the support and the adherend becomes. As the amount of light increases, however, the support is colored and becomes brittle. For an ordinary plastic film such as polyester or polyolefin, therefore, it is desirable to use a high pressure mercury lamp with a dominant wavelength of 365 nm and having an amount of irradiation light of 20 to 10,000 mJ/cm$^2$, preferably 50 to 2,000 mJ/cm$^2$. When a low pressure mercury lamp with a dominant wavelength of 254 nm is used, that having an amount of irradiation light of 100 to 10,000 mJ/cm$^2$, preferably 300 to 1,500 mJ/cm$^2$, is desirable.

For flame treatment, liquefied propane gas or natural gas can be used. The gas/air mixture ratio (volume ratio) is important. When liquefied propane gas is used, the mixture ratio is preferably 1/14 to 1/22, more preferably 1/16 to 1/19. When natural gas is used, the mixture ratio is preferably 1/6 to 1/10, more preferably 1/7 to 1/9.

The amount of treating flame is preferably 1 to 50 Kcal/m$^2$, more preferably 3 to 20 Kcal/m$^2$. Setting the distance between the tip of the inner flame of the burner and the support at less than 4 cm is more effective. As the treating apparatus, a flame treating machine of KASUGA ELECTRIC WORKS LTD., for example, may be used. A backup roller for supporting the support during treatment is preferably a hollow roll, and it is preferred to pass a cooling liquid through the roll so that the roll is kept at a predetermined constant temperature.

Glow discharge treatment is an effective method of surface treatment, and any known method may be used. Examples of the usable methods are described in Japanese Patent Publication Nos. 35-7578, 36-10336, 45-22004, 45-22005, 45-24040 and 46-43480, U.S. Pat. Nos. 3,057,792, 3,057,795, 3,179,482, 3,288,638, 3,309,299, 3,424,735, 3,462,335, 3,475,307 and 3,761,299, British Patent No. 997,093 and Japanese Unexamined Patent Publication No. 53-129262.

There may be methods carried out with various special gases such as oxygen, nitrogen, helium or argon being introduced into an atmosphere of glow discharge treatment. In the case of a polyester support, however, the introduction of the special gas is not suitable industrially, because it does not markedly improve adhesiveness and the gas is expensive. The introduction of $H_2O$ (steam), on the other hand, is an industrially satisfactory method, since this method shows an adhering effect equal to or higher than the introduction of the special gas and the price of steam is very low.

When glow discharge treatment is performed in the presence of $H_2O$, the partial pressure of $H_2O$ is preferably 5% or more but 100% or less, more preferably 10% or more but 85% or less, and most preferably 25% or more but 75% or less. If the $H_2O$ partial pressure is less than 5%, it is difficult to obtain sufficient adhesion strength. The gas other than $H_2O$ is air comprising oxygen, nitrogen, etc. The quantitative introduction of $H_2O$ into the treating atmosphere of glow discharge can be achieved, for example, by guiding the gas from a sampling tube attached to a glow discharge treating device into a tetrode type mass spectroscopic analyzer (MSQ-150, a product of Nippon Shinku Co., Ltd.), and quantitatively determining the composition there.

Vacuum glow discharge treatment of a preheated film to be surface-treated is preferred. This is because adhesiveness is enhanced by a shorter time of treatment than treatment at an ordinary temperature, and yellowing can be decreased markedly. The preheating temperature is preferably 50° C. or higher but Tg or less. Preheating at a temperature of higher than Tg slightly reduces adhesion. As a way of raising the polymer surface temperature in vacuum, there is heating with an infrared heater, or heating by contact with a hot roll. The treating conditions to be controlled, other than the above-mentioned $H_2O$ partial pressure and the preheating temperature for the support, include, for example, degree of vacuum, interelectrode voltage, and discharge frequency. By controlling these treating conditions, it becomes possible to perform glow discharge treatment which achieves both of high adhesiveness and suppression of yellowing.

The pressure during glow discharge treatment is preferably 0.005 to 20 Torr, and more preferably 0.02 to 2 Torr. If this pressure is too low, the surface of the support cannot be fully modified, and sufficient adhesion cannot be obtained. Too high a pressure, on the other hand, results in the failure to cause stable discharge. The voltage is preferably 500 to 5,000 V, and more preferably 500 to 3,000 V. If this voltage is too low, the surface of the support cannot be fully modified, and sufficient adhesion cannot be obtained. Too high a voltage, on the other hand, results in the deterioration of the surface, and adhesiveness decreases. The frequency used for discharge is from a direct current in the ordinary range to several thousand MHz, preferably 50 Hz to 20 MHz, and more preferably 1 KHz to 1 MHz. The intensity of discharge treatment is preferably 0.01 to 5 $KV \cdot A \cdot min/m^2$, and more preferably 0.15 to 1 $KV \cdot A \cdot min/m^2$.

The so glow discharge treated support is preferably immediately cooled by the use of a cooling roll. As the temperature of the support rises, the support is liable to plastic deformation by an external force, and the flatness of the treated support is impaired. Furthermore, low molecular weight products such as a monomer and an oligomer may precipitate on the surface of the support, adversely affecting the transparency or blocking resistance.

There is no particular limitation on the image forming substance used for the image forming layer in the invention. For example, the ablative dyes disclosed in Japanese Unexamined Patent Publications Nos. 7-149,065, 7-149,066 and 8-104,065, and U.S. Pat. No. 4,541,830, 4,698,651, 4,695,287, 4,701,439, 4,757,046, 4,743,582, 4,769,360 and 4,753,922, which are hereby incorporated by reference, can be used in the invention.

A preferable image forming substance in the invention is an inorganic fine particle. Applicable inorganic fine particles include carbon black, titanium black, graphite, colloidal silver, silver sulfide colloid and metal oxides. The color after coating inorganic fine particles used in the invention should have absorption within the UV-region in the case of image forming for printing and plate-making purposes, and should be black for medical uses. The particle size which gives a color of the inorganic particulate, which largely varies with circumstances, should preferably be within a range of from 5 to 500 nm, more preferably from 5 to 250 nm.

Any manufacturing process of inorganic fine particles satisfying the foregoing particle size condition may be employed in the invention. For preparing a carbon black material, for example, any of the processes such as the channel method as disclosed in Donnel Voet, "Carbon Black" published by Marcel Dekker Inc. (1976), the thermal method and the furnace method are applicable.

The coating amount of the image forming substance such as the inorganic fine particles in the image forming layer may be to any extent so far as it gives a concentration of at least 2.5 (an absorption value within the UV-region for printing purposes, and an absorption value within the visual region for medical uses) in the laser non-irradiated portion, and also varies with the kind of the image forming substance used and the size. Coating of carbon black (primary particle size: 23 nm) in 0.67 $g/m^2$ provides a UV-concentration of 4.0 and a visual concentration of 2.7. Coating of titanium black (particle size: 58 nm) in 0.74 $g/m^2$ provides a UV-concentration of 4.0 and a visual concentration of 3.6.

Wide variety of binders may be used in the image forming layer side of the recording material of the invention provided that the components of the layers are dispersed in the binders. Preferable binders are decomposable polymers which are quickly pyrolized by heat generated from laser irradiation and gives a gas in a sufficient quantity and a volatile fragment, or a decomposable polymer of which the decomposition temperature considerably decreases in the present of a slight amount of an acid. Preferable ones of such decomposable polymer include those having a polystyrene equivalent molecular weight of over 100,000 as measured by size-excluded chromatography disclosed in U.S. Pat. No. 5,330,876 which is hereby incorporated by reference (F. W. Billmeyer, "Textbook of Polymer Science", 2nd ed., 53–57).

Particularly preferable binders for the image forming layer side of the recording material of the invention are nitric esters of carboxyalkyl cellulose and cellulose nitrate. Nitric esters of carboxyalkyl cellulose are prepared by reacting a carboxy alkylcellulose such as carboxymethyl cellulose and hydroxyethyl cellulose with a mixed acid for nitric esterization comprising for example sulfuric acid, nitric acid and water to achieve a degree of nitric ester group substitution in the carboxyalyl cellulose of at least 0.2 and a degree of carboxyalkyl ether group substitution of at least 0.05. Examples of the nitric esters of carboxyalkyl cellulose include the aqueous cellulose derivatives disclosed in Japanese Unexamined Patent Publications Nos. 5-39301 and 5-39302 which are hereby incorporated herein by reference.

The nitric esters of carboxyalkyl cellulose used in the invention preferably have a degree of nitric ester group substitution within the range of from 0.2 to 2.2 and a degree of carboxyalkyl ether group substitution within the range of from 0.05 to 1.5. A degree of nitric ester group substitution of under 0.2 is not desirable because of insufficient dispersibility and water resistance of a developer and a dye. A degree of carboxyalkyl ether group substitution of under 0.05 leads to an insufficient solubility in water, as to practical impossibility to use the same as a water-soluble binder.

A degree of nitric ester group substitution of over 2.2 is not desirable because of the necessity of increasing the consumption of an organic solvent to dissolve or disperse the same in a mixed solvent of water and an organic solvent. A degree of carboxyalkyl ether group substitution of over 1.5 tends to a slightly insufficient water resistance of the coated surface. Carboxyl group of nitric ester of carboxyalkyl cellulose used in the invention may be partially or totally neutralized. Neutralization increases solubility into water and a water-soluble organic solvent mainly comprising water. For the purpose of neutralizing the carboxyl group, one or more of an alkali metal ion, an alkali earth metal ion, ammonium ion and a cation of an organic amine or the like may be used. The extent of neutralization, depending upon the chemical composition of the target solution including water and organic solvent contents, should preferably be in general such that 50% or more of carboxyl group are neutralized.

Nitric ester of carboxyalkyl cellulose may be appropriately used for any of the layers on the image forming layer side, including a image forming layer, an intermediate layer between a support and the image forming layer, and an overcoat layer on the image forming layer.

The amount of coated nitric ester of carboxyalkyl cellulose should preferably be within a range of from 0.05 to 5 $g/m^2$, or more preferably, of from 0.1 to 3 $g/m^2$.

In the recording material of the invention, a nitric ester of carboxyalkyl cellulose may be used either alone or in combination with at least one of known binders.

The laser ablative recording material of the invention has a intermediate layer between the support and the image forming layer. The intermediate layer preferably contains a material having absorption in the laser wavelength region. Such an intermediate layer can reduce Dmin of the laser-irradiated portion and increase the ablation efficiency.

Any binders which can be used in the image forming layer can be used in the intermediate layer either alone or in combination. The amount of coated binder should be determined to reduce Dmin as possible, preferably be within a range of from 0.05 to 2 g/m$^2$, more preferably from 0.1 to 1.5 g/m$^2$. When the intermediate layer is to have a function of a primer layer to improve close contact with the support, the amount of coated binder should preferably be within a range of from 0.05 to 0.5 g/m$^2$.

In the recording material of the invention, an overcoat layer maybe provided for the purpose of imparting satisfactory scraping resistance, wear resistance and mat finish. Provision of the overcoat layer permits easy handling because of the slightest risk of discoloration of the formed image caused by finger prints or the like.

Beads may be contained in the overcoat layer. Particularly, polytetrafluoroethylene beads should preferably be contained. The particle size and the coating amount of polytetrafluoroethylene beads can be set within a range effective for achieving the intended object. In general, the particle size should preferably be within a range of from about 0.1 to about 20 $\mu$m, or more preferably, from about 0.1 to about 5 $\mu$m. The coating amount should be within a range of from about 0.005 to about 5.0g/m$^2$, or more preferably, within a range of from about 0.05 to about 0.5 g/m$^2$. Polytetrafluoroethylene beads are not necessarily required to be in a spherical shape, but may be in any arbitrary shape.

As the binder of the overcoat layer containing beads, any arbitrary polymer may be used. More specifically, applicable polymers include cellulose derivatives such as cellulose nitrate, cellulose acetate hydrogen phthalate, cellulose acetate, cellulose acetate propionate, cellulose acetate butylate, cellulose triacetate, hydroxypropyl cellulose ether, ethyl cellulose ether; polycarbonate; polyurethane; polyester; poly(vinyl acetate); poly (vinyl halide) such as poly (vinyl chloride) and poly(vinyl chloride) copolymers; poly (vinyl ether); maleic acid anhydride copolymer; polystyrene; poly(styrene-co-acrylonitrile); polysulfon; poly (phenylene oxide); poly(ethylene oxide); poly(vinylalcohol-co-acetal) such as poly(vinyl acetal), poly(vinylacetal-co-butyral) and poly(vinylbenzal); and mixtures and copolymers thereof. The binder for the overcoat layer can be used in a coating amount within a range of from about 0.1 to about 5 g/m$^2$.

The laser ablative recording material of the invention contains a material having absorption in the laser wavelength region. The material having absorption in the laser wavelength region may be contained in the image forming layer, or in the intermediate layer present between the support and the image forming layer, or in the layer on the image forming layer.

When the irradiated laser is an infrared laser, the material having absorption in the laser wavelength region should be an infrared-absorbing material. The amount of coated infrared-absorbing material should have a laser wavelength absorbance of over 0.5, or preferably, over 1.0, or more preferably, over 1.5. Applicable infrared-absorbing materials include, for example, carbon black, cyanic infrared-absorbing dye disclosed in U.S. Pat. No. 4,973,572, and materials disclosed in U.S. Pat. Nos. 4,948,777, 4,950,640, 4,950,639, 4,948,776, 4,948,778, 4,942,141, 4,952,552, 5,036,040, 4,912,083, 5,360,694, 5,380,635 and JPA No. 8-189,817. These patent publications are hereby incorporated by reference.

Typical examples of infrared-absorbing material suitably applicable for the laser ablative recording material of the invention are presented below. Infrared-absorbing materials applicable for the laser ablative recording material of the invention are not however limited to those enumerated below.

(1)

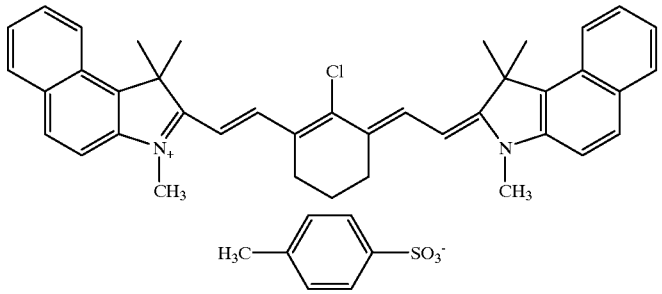

(2)

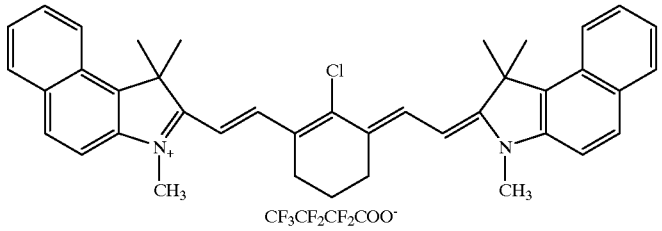

-continued
(3)
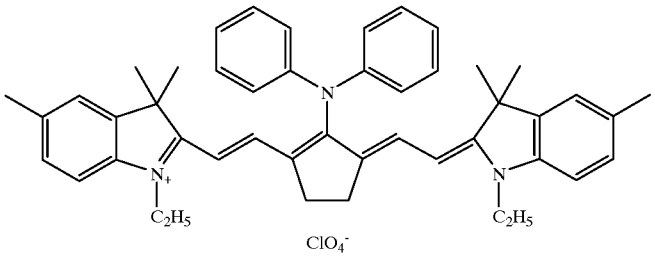
(4)
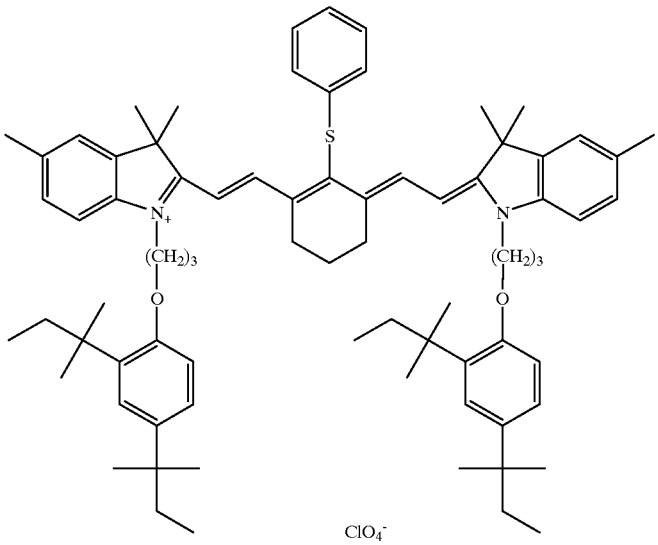
(5)
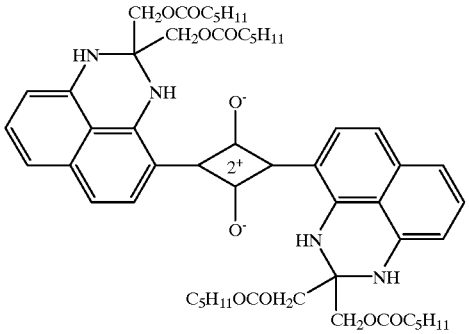
(6)
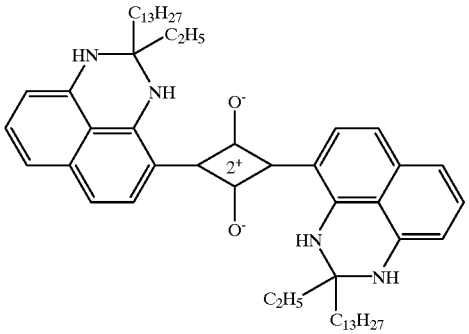
(7)
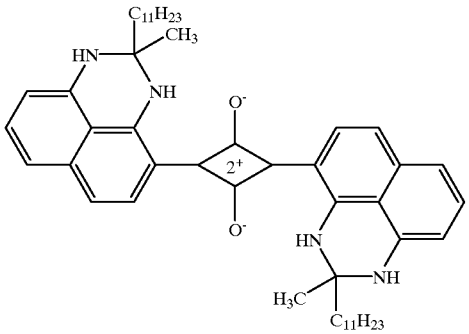
A backcoat layer may be provided in the laser ablative recording material of the invention. The backcoat layer may be formed on the surface of the support on the opposite side to the image forming layer.

From the point of view of adhesivity and strippability between recording materials, the outermost layer surface of the backcoat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the backcoat layer. In the invention, the matting agent should preferably have an average particle size of up to 20 $\mu$m, or more preferably, within a range of from 0.4 to 10 $\mu$m. The quantity of added matting agent should preferably be within a range of from 0.5 to 400 mg/m$^2$, or more preferably, from 1.0 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4, an alkali surface-modifying matting agent disclosed in Japanese Unexamined Patent Publication No. 4-127,142, page 3, right upper column, line 7 through page 5, right lower column, line 4, or an organic polymer matting agent 11 disclosed in Japanese Unexamined Patent Publication No. 6-118542, paragraph Nos. [0005] to [0026]. These patent publications and application are hereby incorporated by reference.

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 $\mu$m disclosed in Japanese Unexamined Patent Publication No. 6-118542 which is hereby incorporated by reference and a matting agent having an average particle size of up to 1 $\mu$m)

A conductive layer having a surface resistance of up to $10^{12}\Omega$ at 25° C. and 30% RH is preferably provided in the recording material of the invention. The conductive layer may be provided either on the image forming layer side of the support or on the backcoat layer side. A single conductive layer or two or more such layers may be provided. Further, the conductive layer may be prepared by adding a conductive material to a layer having other functions such as a surface protecting layer, a backcoat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2$, $Al_2O_3$, $In_2O_3$, $SiO_2$, MgO, BaO, $MoO_3$ and $V_2O_5$ and composite oxides thereof. Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$ Ω·cm, or more preferably, up to $10^5$ Ω·cm. These oxides are disclosed in Japanese Unexamined Patent Publications Nos. 56-143,431, 56-120,519 and 58-62,647 which are hereby incorporated by reference.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235 which is hereby incorporated by reference.

The conductive material used in the invention should preferably have a particle size of up to 10 $\mu$m, or more preferably, up to 2 $\mu$m with a view to ensuring stability after dispersion. In order to achieve the lowest possible light scattering, it is desirable to use conductive particles having a particles size of up to 0.5 $\mu$m. Use of such conductive particles permits maintenance of transparency of the support by providing a conductive layer.

When the conductive material is acicular-shaped or fibrous, the material should preferably have a length of up to 30 $\mu$m and a diameter of up to 2$\mu$m, or more preferably, a length of up to 25 $\mu$m and a diameter of up to 0.5 $\mu$m, with a length/diameter ratio of at least 3.

Preferable conductive polymeric compounds applicable in the invention include polyvinylbenzenesulfonic salts, polyvinylbenziltrimethylammonium chloride, grade-4 polymers as disclosed in U.S. Pat. Nos. 4,108,802, 4,118,231, 4,126,467, and 4,137,217 which are hereby incorporated by reference, and polymer latexes as disclosed in U.S. Pat. No. 4,070,189, West German Unexamined Patent Publication No. 2,830,767, Japanese Unexamined Patent Publications Nos. 61-296,352 and 61-62,033.

Some concrete examples of the conductive polymeric compound of the invention are enumerated below. Conductive materials applicable in the invention are not however limited to those presented below. The composition of the following polymers is expressed in percentage of polymerization.

E-1

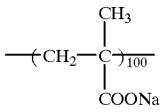

E-2

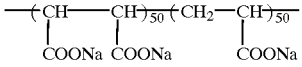

-continued

E-3

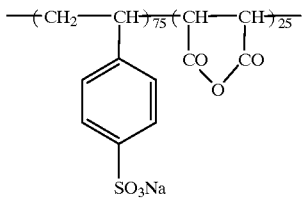

E-4

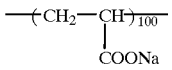

E-5

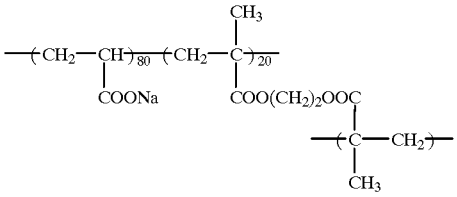

E-6

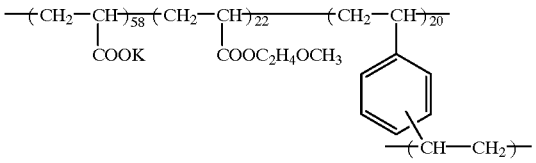

E-7

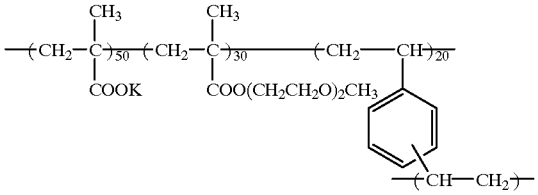

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatine and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatine (lime-treated gelatine, acid-treated gelatine, enzyme-decomposed gelatine, phthalized gelatine, acetylated gelatine, etc.), acetylcellulose, diacetylcellulose, triacetylcellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}$ Ω under conditions including 25° C. and 30% RH, or more preferably, up to $10^{11}$ Ω.

A better antistatic property can be imparted by simultaneously using a fluorine-containing surfactant in addition to the foregoing conductive material. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No. 49-10,722, British Patent No. 1,330,356, U.S. Pat. Nos. 4,335,201, 4,347,308, B.P. No.1,417,915, Japanese Unexamined Patent Publication No. 55-149,938, 58-196,544, and B.P. No. 1,439,402 which are hereby incorporated by reference.

Examples of the fluorine-containing surfactant applicable in the conductive layer are enumerated below.

F-1

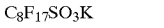

F-2

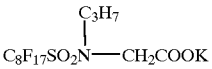

F-3

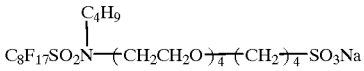

F-4

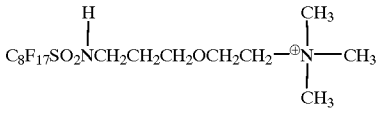

F-5

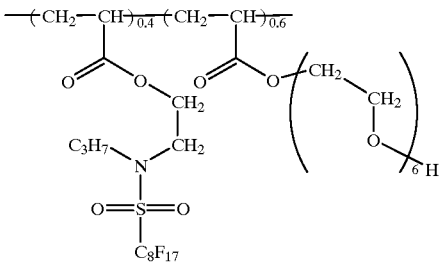

An image can be recorded on the recording material of the invention in accordance with an ordinary laser ablation recording method. In the present invention, image forming based on the single sheet method is possible without the necessity of a receiving material since laser irradiation is accomplished from the image forming layer side.

The ablative recording material of the invention should have a Dmin of up to 0.11 after laser irradiation, as is described in Japanese Unexamined Patent Publication No. 8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 mW/gm$^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation).

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400 which is hereby incorporated by reference.

A laser ablative record with an image formed by laser irradiation onto the recording material of the invention should preferably be subjected to a treatment for increasing durability of the image. For example, a protecting layer may be formed on the surface of the image forming layer side for the protection of the image.

The protecting layer may be formed by the use of an image protecting laminated sheet disclosed in Japanese Unexamined Patent Publication Nos. 5-504,008 and 6-344,676, which are hereby incorporated by reference. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed fact to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676 which is hereby incorporated by reference, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676 which is hereby incorporated by reference. A siloxane-containing polymeric material can be prepared, for example, through co-polymerization of an organic monomer or oligomer functionalized with a vinylether group and a siloxane monomer or oligomer. One prepared by any other method is also applicable. The protecting layer on the image has usually a thickness of up to 30 $\mu$m, and in order to prevent an excessive decrease in resolution, the thickness should preferably be up to 10 $\mu$m, or more preferably, within a range of from 0.5 to 6 $\mu$m.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image may be selected and formed on the recording material of the invention in response to the purpose of use, A person skilled in the art could appropriately select a support of the recording material and a material for the coloring agent for the recording material of the invention, depending upon a particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

A binder A solution used in the Examples is a 15% solution of nitric ester of carboxymethyl cellulose (acetone: 40%; methanol: 20%; water: 25%; pH adjusted to 6.9 by the use of ammonia water) having a degree of nitric ester group substitution of 2.1 and a degree of carboxymethyl ether group substitution of 0.7 per unit of glucose anhydride.

Compound A-1 and A-2 used in the Examples are expressed by the following structural formula:

Compound A-1

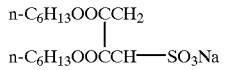

Compound A-2

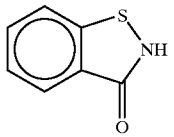

<Surface treatment of support>

Support 1 for the present invention and Supports 2 to 4 for controls were prepared by the following procedure:

Both surfaces of a 100 $\mu$m thick polyethylene terephthalate film were glow discharge treated at a treating atmosphere pressure of 0.2 Torr, a water partial pressure in the atmosphere gase of 40%, a discharge frequency of 30 kHz, a power of 2,500 W, and a treating intensity of 0.5 kV·A·min/m$^2$ to make Support 1.

A 100 $\mu$m thick polyethylene terephthalate film which was not surface-treated was used as Support 2.

Corona discharge was performed onto a biaxially stretched, 100 $\mu$m thick polyethylene terephthalate film. A first undercoat layer coating solution having a composition indicated below was applied to both surfaces of the film by a wire bar coater to a coating amount of 4.9 ml/m$^2$ each, and dried for 1 minute at 185° C. Then, the first undercoat layer formed on each surface of the film was coated with a second undercoat layer coating solution having a composition indicated below by means of a wire bar coater so that the coating amount of Compound A-1 would be 0.18 g/m$^2$. The laminate was dried at 155° C. to make Support 3.

TABLE 1

Composition of undercoat layer coating solution

| Constituent | Parts |
|---|---|
| First undercoat layer coating solution: | |
| Butadiene-styrene copolymer latex solution (solids content 40%; butadiene/styrene weight ratio = 31/69; containing 0.4% by weight, based on the latex solids content, of Compound A-1 as an emulsifying dispersant) | 158 parts by volume |
| A 4 weight % solution of 2,4-dichloro-6-hydroxy-s-triazine sodium salt | 41 parts by volume |
| Distilled water | 801 parts by volume |
| Second undercoat layer coating solution: | |
| Gelatin | 505 parts by weight |
| Compound A-2 | 1,800 parts by weight |
| Polymethyl methacrylate (average particle size 2.5 μm) | 28 parts by weight |

Both surfaces of a 100 μm thick polyethylene terephthalate film were corona discharge treated at a rate of 10 m/min using a solid state corona treating machine (6KVA Model, a product of Pillar) to make Support 4.

<Formation of first back layer (conductive layer)>

230 Parts by weight of stannic chloride hydrate and 23 parts by weight of antimony trichloride were dissolved in 3,000 parts by weight of ethanol to prepare a uniform solution. To this solution, a 1N aqueous solution of sodium hydroxide was added dropwise to adjust the pH to 3 and form a colloidal coprecipitate of stannic oxide and antimony oxide. This coprecipitate was allowed to stand for 24 hours at 50° C. to convert it into a red brown colloidal precipitate. The red brown colloidal precipitate was separated by centrifugation, and water was added, followed by centrifugation. This water-washing procedure was repeated 3 times to remove excess ions.

200 Parts by weight of the colloidal precipitate cleared of the excess ions were dispersed in 1,500 parts by weight of water. The resulting dispersion was sprayed onto a firing furnace heated to 500° C. to obtain a stannic oxide-antimony oxide composite as a bluish fine powder. The average particle size of this fine powder was 0.005 μm, and its resistivity was 25 Ω·cm.

40 Parts by weight of the resulting fine powder were mixed with 60 parts by weight of water, and the mixture was adjusted to pH7.0 and coarsely dispersed using a stirrer. Then, the system was dispersed for 30 minutes by means of a horizontal sand mill (Dynomill; made by Willy A. Backfen AG) to prepare a dispersion of a secondary agglomerate (average particle size: 0.05 μm) comprising partially agglomerated primary particles.

The resulting conductive fine particle dispersion was used to prepare a first back layer coating solution having the composition indicated below. This first back layer coating solution was coated onto the surface of the support, and dried for 30 seconds at 110° C. to form a first back layer having a dry thickness of 0.3 μm.

TABLE 2

Composition of first back layer coating solution

| Constituent | Parts by weight |
|---|---|
| Conductive fine particle dispersion above ($SnO_2/Sb_2O_3$: 0.05 μm) | 100 |
| Lime-treated gelatin ($Ca^{2+}$ content: 100 ppm) | 10 |
| Water | 270 |
| Methanol | 600 |
| Resorcin | 20 |
| Polyoxyethylene nonylphenyl ether (degree of polymerization: 10) | 0.1 |

<Formation of Second Back Layer>

A second back layer coating solution having the following composition was coated onto the first back layer, and the coating was dried at 110° C. to form a second back layer having a dry thickness of 1.2 μm.

TABLE 3

Composition of second back layer coating solution

| Constituent | Parts by weight |
|---|---|
| Diacetyl cellulose | 100 |
| Trimethylolpropane-3-toluene diisocyanate | 25 |
| Methyl ethyl ketone | 1050 |
| Cyclohexanone | 1050 |
| Crosslinkable polymer matting agent (copolymer of methyl methacrylate and divinyl benzene (9:1), average particle size: 3.5 μm) | 2 |

<Formation of third back layer (lubricating layer)>

The constituents of the below-described Solution A were mixed and heated to 90° C. to form a solution. This solution was added to Solution B having the below-described composition. The resulting mixture was dispersed by a high pressure homogenizer to obtain a third back layer coating solution. The third back layer coating solution was coated onto the second back layer in a coating amount of 10 ml/m$^2$, and then dried.

TABLE 4

Composition of third back layer coating solution

| Constituent | Parts by weight |
|---|---|
| [Solution A] | |
| Lubricant: $C_6H_{13}CH(OH)(CH_2)_{10}COOC_{40}H_{81}$ | 0.7 |
| Lubricant: n-$C_{17}H_{35}COOC_{40}H_{81}$-n | 1.1 |
| Xylene | 2.5 |
| [Solution B] | |
| Propylene glycol monomethyl ether | 34.0 |
| Diacetyl cellulose | 3.0 |
| Acetone | 600.0 |
| Cyclohexanone | 350.0 |

<Formation of intermediate layer>

One of intermediate layer coating solutions having the following compositions was coated onto the surface of the support opposite to the back layer in a coating amount of nitric ester of carboxymethyl cellulose of 0.5 g/m$^2$.

TABLE 5

Composition of intermediate layer coating solution

| Intermediate layer | Constituent | Parts by weight |
|---|---|---|
| 1 | Binder A solution | 11.3 |
| | Acetone | 8.8 |
| | Methanol | 4.4 |
| | Water | 5.5 |
| 2 | Binder A solution | 11.3 |
| | Acetone | 8.8 |
| | Methanol | 4.4 |
| | Water | 5.5 |
| | Infrared absorbing material (1) | 0.16 |

<Formation of image forming layer>

One of image forming layer coating solutions prepared by uniformly dispersing individual mixtures of the following compositions by means of a paint shaker was coated onto the intermediate layer. For a image forming layer 1, the solution was coated in a coating amount of carbon black of 0. 67 g/m$^2$; for a image forming layer 2, the solution was coated in a coating amount of titanium black of 0.74 g/m$^2$.

TABLE 6

Composition of image forming layer coating solution

| Image forming layer | Constituent | Parts by weight |
|---|---|---|
| 1 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co.) | 0.23 |
| | Carbon black (particle size: 23 nm, oil absorption: 66 ml/100 g) | 5 |
| | Fluorine-containing surfactant F-5 | 0.0373 |
| 2 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co.) | 0.23 |
| | Titanium black 12S (particle size: 58 nm; made by Mitsubishi Materials Corp.) | 5.5 |
| | Fluorine-containing surfactant F-5 | 0.0338 |

<Formation of overcoat layer>

One of overcoat layer coating solutions having the following compositions was coated onto the image forming layer. The solution was coated in a coating amount of a binder of 0.25 g/m$^2$.

TABLE 7

Composition of overcoat layer coating solution

| Overcoat layer | Constituent | Parts by weight |
|---|---|---|
| 1 | Polyethyl methacrylate | 0.25 |
| | Polytetrafluoroethylene beads (Zonyl TLP-10F-1; particle size 0.2 μm; made by DuPont) | 0.1 |

TABLE 7-continued

Composition of overcoat layer coating solution

| Overcoat layer | Constituent | Parts by weight |
|---|---|---|
| | Florene TG710 (made by Kyoeisha Kagaku Co.) | 0.03 |
| 2 | Nitric ester of carboxymethyl cellulose contained in the binder A | 0.25 |
| | Polytetrafluoroethylene beads (Zonyl TLP-10F-1; particle size 0.2 μm; made by DuPont) | 0.1 |
| | Florene TG710 (made by Kyoeisha Kagaku Co.) | 0.03 |

Combinations of the intermediate layer, the image forming layer and the overcoat layer for the individual recording materials are as shown in Table 8.

<Evaluation of adhesion in dry condition>

The image forming layer coated surface was given 13 cuts at 7 mm intervals in each of the longitudinal direction and the transverse direction to form rhombic spaces. A polyester adhesive tape (a product of Nitto Denki Kogyo) was applied onto the cut tape, and peeled off rapidly in a 180-degree direction. The sample whose surface showed no peeling was evaluated as Grade A. The sample 95% or more of whose surface remained unpeeled was evaluated as Grade B. The sample 90% or more of whose surface remained unpeeled was evaluated as Grade C. The sample 60% or more of whose surface remained unpeeled was evaluated as Grade D. The sample less than 60% of whose surface remained unpeeled was evaluated as Grade E. The product that received Grade A or Grade B of the above 5-grade evaluation scale is an ablative recording material having adhesion strength sufficient for practical use. The results are shown in Table 8.

<Exposure conditions for image recording>

Each recording material was fixed, with the image forming layer directed outward, to a drum of the same image exposure apparatus as disclosed in Japanese Unexamined Patent Publication No. 8-48,053. Each laser beam had a wavelength range of 830 to 840 nm. Its nominal power on the film surface was 550 mW, and its spot size thereon was 25 μm. The number of revolutions of the drum wound with the recording material was varied to adjust the amount of irradiation for appropriate exposure. For transverse movement, a diode laser was moved by a traveling stage at a speed set so that the center distance of the irradiated beams would be 10 μm. Furthermore, the same apparatus as disclosed in Japanese Unexamined Patent Publication No. 8-72,400 was used to blow an air stream during laser irradiation. Thus, the image forming substances and binder were efficiently removed from the laser irradiated surface.

<Measurement of Dmax and Dmin in UV region>

The densities at the laser-non-irradiated area and the laser-irradiated area were measured by means of a densitometer using a UV filter (TD904; made by Macbeth Co.), and the respective measured values were recorded as Dmax (maximum density) and Dmin (minimum density) in the UV region. The results are shown in Table 8.

TABLE 8

Constituents and results of density measurement of each recording medium

| Recording medium No. | Support No. | Intermediate layer No. | Image forming layer No. | Overcoat layer No. | $H_2O$ partial pressure (%) | Dmax | Dmin | Adhesion evaluation |
|---|---|---|---|---|---|---|---|---|
| 1 (present invention) | 1 | 1 | 1 | 1 | 5 | 4.0 | 0.07 | B |
| 2 (present invention) | 1 | 1 | 1 | 1 | 10 | 3.9 | 0.11 | A |
| 3 (present invention) | 1 | 1 | 1 | 1 | 40 | 3.9 | 0.09 | A |
| 4 (present invention) | 1 | 1 | 1 | 1 | 70 | 4.0 | 0.09 | A |
| 5 | 2 | 1 | 1 | 1 | — | 4.0 | 0.06 | E |
| 6 | 3 | 1 | 1 | 1 | — | 3.9 | 0.19 | A |
| 7 | 4 | 1 | 1 | 1 | — | 3.9 | 0.14 | A |
| 8 (present invention) | 1 | 1 | 2 | 1 | 40 | 4.0 | 0.09 | A |
| 9 (present invention) | 1 | 2 | 1 | 1 | 40 | 3.9 | 0.07 | A |
| 10 (present invention) | 1 | 2 | 2 | 1 | 40 | 4.0 | 0.07 | A |
| 11 (present invention) | 1 | 1 | 1 | 2 | 40 | 4.0 | 0.08 | A |
| 12 (present invention) | 1 | 2 | 1 | 2 | 40 | 3.9 | 0.07 | A |

Recording material 5 using Support 2 that was not surface-treated had a low Dmin, but was poor in adhesion. Recording material 6 using Support 3 provided with the undercoat layer, and Recording material 7 using Support 4 that was corona discharge treated had high Dmin's probably because of too high adhesion strength. The recording materials of the present invention using the glow discharge treated Support 1, on the other hand, were satisfactory in adhesion, and had low Dmin's. The $H_2O$ partial pressure of 5% or more during glow discharge was acceptable for practical use, and this pressure of 10% or more imparted even better physical properties to the recording material (comparison of Recording materials 1 to 4).

Recording materials 3 and 8 to 12 of the present invention were laser exposed by the same device as a thermographic image setter (Genasett Dry 1070, DAINIPPON SCREEN MFG., CO., LTD.). Their Dmin's were confirmed to be low similar to the above results.

What is claimed is:

1. A laser ablative recording material having:

a plastic support with a surface;

at least one image forming layer on said plastic support, said support surface having been surface-treated by glow discharge treatment in an atmosphere where the partial pressure of $H_2O$ is 5% or higher; and at least one polymeric intermediate layer between the image forming layer and the plastic support, wherein the intermediate layer acts as a primer layer in contact with the surface of the support.

2. The laser ablative recording material as claimed in claim 1 wherein the partial pressure of $H_2O$ in the atmosphere of the glow discharge treatment is 10% or higher.

3. The laser ablative recording material as claimed in claim 1, wherein the pressure of the glow discharge treatment is 0.005 to 20 Torr.

4. The laser ablative recording material as claimed in claim 1, wherein the voltage of the glow discharge treatment is 500 to 5,000 V.

5. The laser ablative recording material as claimed in claim 1, wherein the glow discharge treatment is performed on the support, said support having been heated.

6. The laser ablative recording material as claimed in claim 5, wherein the temperature of the heating is between 50° C. and the Tg of the support.

7. The laser ablative recording material as claimed in claim 1, wherein the support is transparent.

8. The laser ablative recording material as claimed in claim 1, which contains a nitric ester of a carboxyalkyl cellulose in at least one of the layers on the image forming layer side of the support.

9. The laser ablative recording material as claimed in claim 8, wherein the nitric ester of the carboxyalkyl cellulose has a degree of nitric ester group substitution per glucose anhydride unit of 0.2 to 2.2, and has a degree of carboxyalkyl ether group substitution per glucose anhydride unit of 0.05 to 1.5.

10. The laser ablative recording material as claimed in claim 1, wherein the image forming layer contains inorganic fine particles as an image forming substance.

11. The laser ablative recording material as claimed in claim 10, wherein the inorganic fine particles are carbon black and/or titanium black.

12. The laser ablative recording material as claimed in claim 1, which has an overcoat layer on the image forming layer.

13. The laser ablative recording material as claimed in claim 12, wherein the overcoat layer contains polytetrafluoroethylene beads.

14. The laser ablative recording material as claimed in claim 1, which has a back layer on the surface of the support on the side opposite to the image forming layer.

15. The laser ablative recording material as claimed in claim 14, wherein the Beck smoothness of the outermost layer surface of the back layer is 4,000 seconds or less.

16. The laser ablative recording material as claimed in claim 1, which has a minimum recording density (Dmin) after laser irradiation of 0.11 or less.

17. A laser ablative image-formed record prepared by irradiating a laser onto the laser ablative recording material as claimed in claim 1.

18. The laser ablative image-formed record as claimed in claim 17, which is prepared by providing a withstanding layer on the surface on the image forming layer side after laser irradiation.

* * * * *